US012085290B2

(12) United States Patent
Tsujimoto et al.

(10) Patent No.: US 12,085,290 B2
(45) Date of Patent: Sep. 10, 2024

(54) HEAT MEDIUM RELAY DEVICE

(71) Applicant: Mitsubishi Electric Corporation, Tokyo (JP)

(72) Inventors: Sara Tsujimoto, Tokyo (JP); Hiroki Takahashi, Tokyo (JP); Yuji Motomura, Tokyo (JP); Hiroki Washiyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 267 days.

(21) Appl. No.: 17/797,214

(22) PCT Filed: May 7, 2020

(86) PCT No.: PCT/JP2020/018501
§ 371 (c)(1),
(2) Date: Aug. 3, 2022

(87) PCT Pub. No.: WO2021/224956
PCT Pub. Date: Nov. 11, 2021

(65) Prior Publication Data

US 2023/0066155 A1 Mar. 2, 2023

(51) Int. Cl.

| | |
|---|---|
| ***F24F 13/30*** | (2006.01) |
| ***F24F 1/16*** | (2011.01) |
| ***F24F 13/32*** | (2006.01) |
| ***F25B 41/20*** | (2021.01) |

(52) U.S. Cl.
CPC ..... *F24F 1/16* (2013.01); *F24F 13/30* (2013.01); *F24F 13/32* (2013.01); *F25B 41/20* (2021.01)

(58) Field of Classification Search
CPC ... F24F 1/16; F24F 13/30; F24F 13/32; F25B 41/20
See application file for complete search history.

(56) References Cited

U.S. PATENT DOCUMENTS

2012/0031130 A1* 2/2012 Morimoto ..... F25B 41/40 62/196.1
2016/0084547 A1 3/2016 Nishioka et al.

FOREIGN PATENT DOCUMENTS

JP 5627542 B2 11/2014
WO 2014/192139 A1 12/2014

OTHER PUBLICATIONS

Extended European Search Report dated May 8, 2023 issued in corresponding European Patent Application No. 20934322.7.
International Search Report of the International Searching Authority mailed Aug. 4, 2020 in corresponding International application No. PCT/JP2020/018501 (and English translation).

* cited by examiner

*Primary Examiner* — Eric S Ruppert
(74) *Attorney, Agent, or Firm* — Posz Law Group, PLC

(57) ABSTRACT

A heat medium relay device includes a valve block provided in a third space, and including a plurality of valves to allow a secondary heat medium subjected to the heat exchange at a first heat exchanger and a secondary heat medium subjected to the heat exchange at a second heat exchanger to flow to at least one indoor unit, the valve block being lighter in weight than each of the first heat exchanger, a first pump, the second heat exchanger, and a second pump.

5 Claims, 8 Drawing Sheets

HEAT MEDIUM RELAY DEVICE

CROSS REFERENCE TO RELATED APPLICATION

This application is a U.S. national stage application of PCT/JP2020/018501 filed on May 7, 2020, the contents of which are incorporated herein by reference.

TECHNICAL FIELD

The present disclosure relates to a vertical heat medium relay device.

BACKGROUND ART

A well-known heat medium relay device of an air-conditioning apparatus has a horizontal housing having a width greater than its height because the heat medium relay device is assumed to be installed above a ceiling. In such a housing of the heat medium relay device, pumps, heat exchangers, and a valve block, etc., are accommodated as main components in a lateral direction of the housing.

The pumps and the heat exchangers accommodated in the housing of the heat medium relay device are heavier than the other components. In addition, in the heat medium relay device, a heat exchanger mainly for heating and a heat exchanger mainly for cooling are provided.

These two heat exchangers are located laterally asymmetrically with reference to the center of the housing of the heat medium relay device (see, for example, Patent Literature 1).

CITATION LIST

Patent Literature

Patent Literature 1: Japanese Patent Publication No. 5627542

SUMMARY OF INVENTION

Technical Problem

Since the two heat exchangers are located laterally asymmetrically, the center of gravity of the heat medium relay device is displaced from a central portion of the heat medium relay device that is the center thereof in the lateral direction. As described above, the housing of the heat medium relay device is horizontally oriented. Thus, for example, in the case where the center of gravity of the heat medium relay device is displaced from the above central portion of the heat medium relay device, when the heat medium relay device is moved by a forklift or stacked on another heat medium relay device, there is a possibility that the heat medium relay device may be displaced or fall down from the other heat medium relay device.

The present disclosure is applied in view of the above circumstances, and relates to a heat medium relay device that can be moved safely.

Solution to Problem

A heat medium relay device according to an embodiment of the present disclosure includes: A heat medium relay device includes: a housing having a vertical cuboid shape, and having an interior partitioned into a first space, a second space above the first space, and a third space above the second space; a first heat exchanger provided in the second space to cause heat exchange to be performed between a primary heat medium and a secondary heat medium, the primary heat medium being in a cooled state and supplied from the outdoor unit; a first pump provided in the first space to pressurize the secondary heat medium subjected to the heat exchange at the first heat exchanger, and circulate the pressurized secondary heat medium between the first pump and at least one indoor unit; a second heat exchanger provided in the second space to cause heat exchange to be performed between the primary heat medium and the second heat medium, the primary heat medium being in a heated state and supplied from the outdoor unit; a second pump provided in the first space, and configured to pressurize the secondary heat medium subjected to the heat exchange at the second heat exchanger, and circulate the pressurized secondary heat medium between the second pump and the indoor unit; and a valve block provided in the third space, and including a plurality of valves to allow the secondary heat medium subjected to the heat exchange at the first heat exchanger and the secondary heat medium subjected to the heat exchange at the second heat exchanger to flow to the indoor unit, the valve block being lighter in weight than each of the first heat exchanger, the first pump, the second heat exchanger, and the second pump.

Advantageous Effects of Invention

According to an embodiment of the present disclosure, the interior of the housing having a cuboid shape is partitioned by a first partition into the first space and the second space above the first space. The interior of the housing is further partitioned by a second partition into the second space and the third space above the second space. The first pump and the second pump are located in the first space. The first heat exchanger and the second heat exchanger are located in the second space. The valve block is lighter in weight than the first pump, the second pump, the first heat exchanger, and the second heat exchanger, and is thus located in the third space.

Because of the above layout, the center of gravity of the housing of the heat medium relay device is located at a low position even in the case where this center of gravity can be displaced from the center of the housing. As a result, this can prevent load collapse and the like of the heat medium relay device, so that a worker who transports the heat medium relay device can move it safely.

DESCRIPTION OF EMBODIMENTS

A vertical flow dividing controller that is a heat medium relay device according to each of the embodiments will be described with reference to the drawings. It should be noted that in each of figures, components that are the same as those in a previous figure or previous figures are denoted by the same reference signs, and after they are each explained once, their explanations will not be repeated, except when the necessity arises. The present disclosure can cover all combinations of configurations that can be combined among configurations explained regarding the embodiments described below.

Embodiment 1

Figure 1:
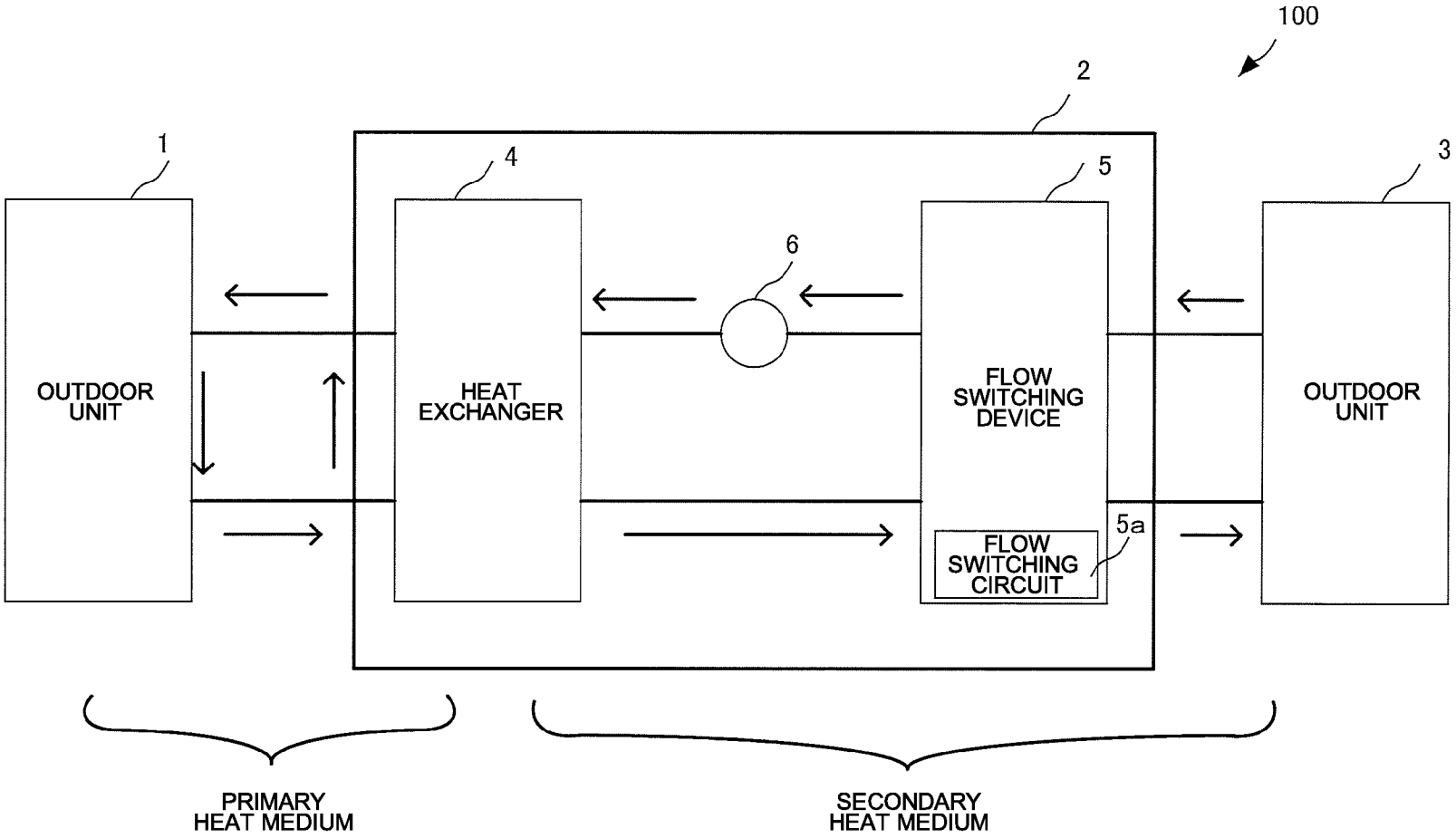
FIG. 1 schematically illustrates a configuration of a heat medium circulation circuit in an air-conditioning apparatus according to Embodiment 1.
Figure 2:
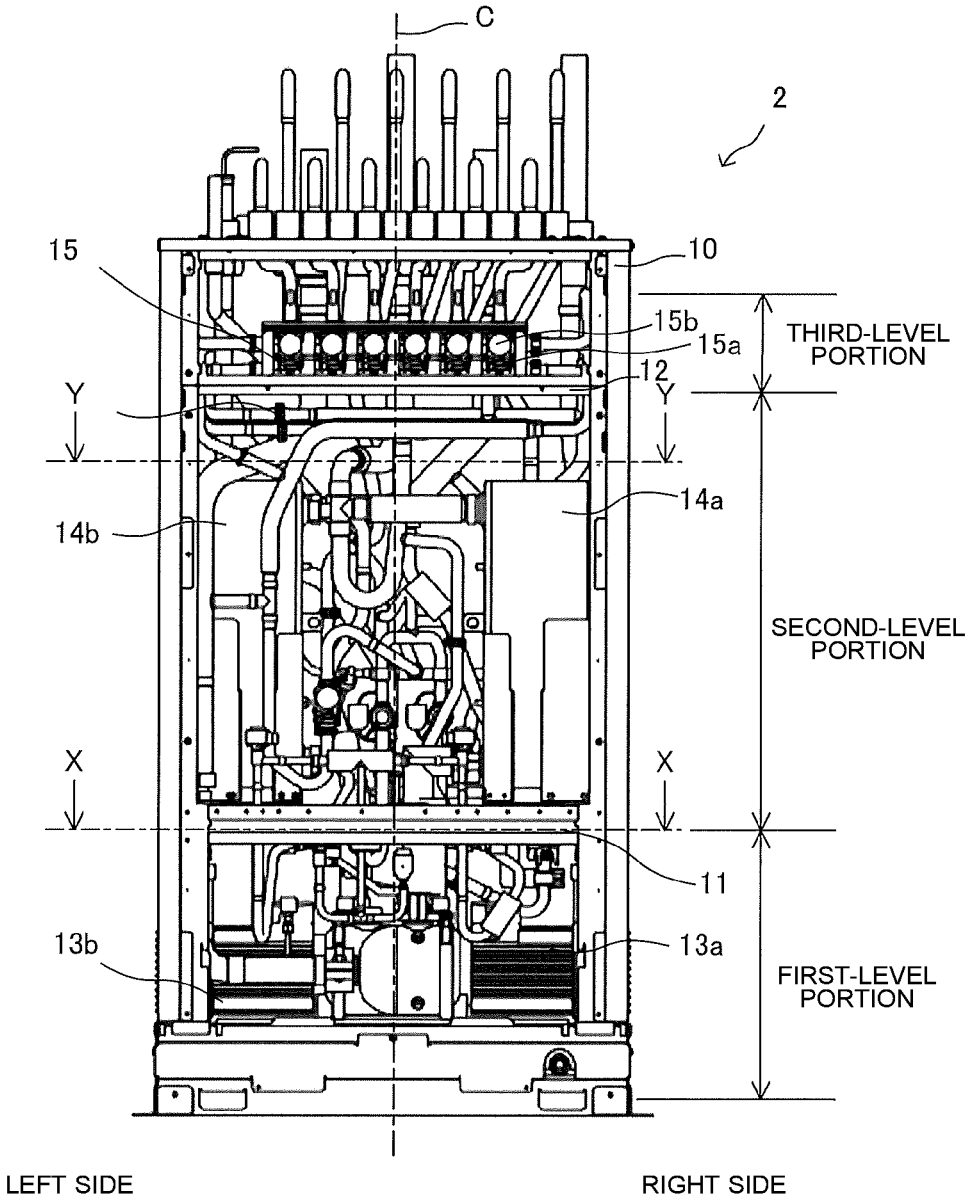
FIG. 2 is a front view of a flow dividing controller in the air-conditioning apparatus according to Embodiment 1.

FIG. 1 schematically illustrates a configuration of a heat medium circulation circuit in an air-conditioning apparatus 100 according to Embodiment 1. FIG. 2 is a front view of a flow dividing controller 2 in an air-conditioning apparatus 100 according to Embodiment 1.

As illustrated in FIG. 1, the flow dividing controller 2 is a heat medium relay device, and is connected between an outdoor unit 1 and an indoor unit 3. In this case, the number of indoor units 3 is one or more; that is, at least one indoor unit 3 is provided.

The flow dividing controller 2 includes a heat exchanger 4, a flow switching device 5, and a pump 6.

The heat exchanger 4 causes heat exchange to be performed between a primary heat medium supplied from the outdoor unit 1 and a secondary heat medium that is water or antifreeze that flows in the indoor unit 3. In Embodiment 1, the heat exchanger 4 includes a first plate heat exchanger 14*a* and a second plate heat exchanger 14*b* as illustrated in FIG. 2.

The first plate heat exchanger 14*a* is used mainly in a cooling operation, and causes heat exchange to be performed between a cooled primary heat medium supplied from the outdoor unit 1 and a secondary heat medium. The second plate heat exchanger 14*b* is used in mainly in a heating operation, and causes heat exchange to be performed between a heated primary heat medium supplied from the outdoor unit 1 and a secondary heat medium.

Referring to FIG. 1, the flow switching device 5 includes a flow switching circuit 5*a*. The flow switching circuit 5*a* changes a flow passage for the secondary heat medium which has been subjected to heat exchange at the heat exchanger 4, thereby to cause the second heat medium to flow to the at least one indoor unit 3. Also, the flow switching device 5*a* causes a secondary heat medium from the at least one indoor unit 3 to flow to the pump 6. The pump 6 pressurizes the secondary heat medium from the flow switching device 5 to circulate the secondary heat medium, and then transfers the pressurized secondary heat medium to the heat exchanger 4. The flow switching circuit 5*a* includes, for example, a four-way valve, a solenoid valve, a check valve, a tank-body protective valve, a three-way valve, and a valve block. The above valve block includes a valve provided at a pipe for the flow switching circuit 5*a*, which causes the secondary heat medium from the heat exchanger 4 to flow to the at least one indoor unit 3.

The pump 6 includes a first pump 13*a* and a second pump 13*b* as illustrated in FIG. 2. The first pump 13*a* pressurizes a secondary heat medium subjected to heat exchange at the first plate heat exchanger 14*a*, and circulates the pressurized secondary heat medium between the first pump 13*a* and the at least one indoor unit 3. The second pump 13*b* pressurizes a secondary heat medium subjected to heat exchange at the second plate heat exchanger 14*b*, and circulates the pressurized secondary heat medium between the second pump 13*b* and the indoor unit 3.

Next, a flow of the heat medium will be described.

First, a primary heat medium transfers heat to or receives heat from outside air in the outdoor unit 1, and flows into the flow dividing controller 2. Then, the heat exchanger 4 causes heat exchange to be performed between the primary heat medium that has flowed into the flow dividing controller 2 and a secondary heat medium. Thereafter, the primary heat medium flows out of the flow dividing controller 2, and then flows back to the outdoor unit 1.

Furthermore, by the pump 6, the secondary heat medium is circulated between the flow dividing controller 2 and the indoor unit 3. At this time, at the heat exchanger 4, the secondary heat medium is heated or cooled by the primary heat medium. The secondary heat medium flows to the at least one indoor unit 3 via the flow switching device 5, and then transfers heat to or receives heat from air of an air-conditioning target space, at a use-side heat exchanger in the at least one indoor unit 3. Thereafter, the secondary heat medium returns to the heat exchanger 4 via the flow switching device 5.

As illustrated in FIG. 2, a housing 10 of the flow dividing controller 2 has a vertically-long cuboid shape. The interior of the housing 10 is partitioned by a first partition 11 into a first space at a first-level portion and a second space at the second-level portion. The interior of the housing 10 is further partitioned by a second partition 12 into the second space at the second-level portion and a third space at a third-level portion. The first partition 11 is provided at a lower level than a central portion of the housing 10 that is the center thereof in an up-down direction. The second partition 12 is provided at an upper position than the central portion of the housing 10 in the up-down direction.

The first pump 13*a* and the second pump 13*b* are located in the first space and laterally symmetrically with reference to a center line C that passes through a central portion of the housing 10 in the horizontal direction and that extends in the vertical direction.

The first plate heat exchanger 14*a* and the second plate heat exchanger 14*b* are located in the second space and laterally symmetrically with reference to the center line C.

A valve block 15 is located in the third space and laterally symmetrically with reference to the center line C. The valve block 15 is lighter in weight than each of the first pump 13*a*, the second pump 13*b*, the first plate heat exchanger 14*a*, and the second plate heat exchanger 14*b*. The valve block 15 includes a plurality of valves 15*a*. At the plurality of valves 15*a*, respective motors 15*b* are provided. Each of the valves 15*a* is provided in a flow switching circuit that causes a secondary heat medium subjected to heat exchange at the first plate heat exchanger 14*a* and a secondary heat medium subjected to heat exchange at the second plate heat exchanger 14*b* to flow to at least one indoor unit. In units of one indoor unit, a valve is provided at a pipe through which a secondary heat medium flows from the flow switching device 5 to the indoor unit 3, and another valve is provided at a pipe through which the secondary heat medium flows from the indoor unit 3 back to the flow switching device 5.

In the flow dividing controller 2 according to Embodiment 1, the interior of the housing 10 having a cuboid shape is partitioned by the first partition 11 into the first space and the second space. The interior of the housing 10 is further partitioned by the second partition 12 into the second space and the third space. The first pump 13*a* and the second pump 13*b* which are heavy are located in the first space. The first plate heat exchanger 14*a* and the second plate heat exchanger 14*b* which are heavy are located in the second space above the first space. The valve block 15 is located in the third space above the second space. The valve block 15 is lighter in weight than the first pump 13*a*, the second pump 13*b*, the first plate heat exchanger 14*a*, and the second plate heat exchanger 14*b*.

Therefore, in the flow dividing controller 2 of Embodiment 1, the first pump 13*a* and the second pump 13*b* which are relatively heavy are located in the first space. The first plate heat exchanger 14*a* and the second plate heat exchanger 14*b* which are heavy are located in the second space. The valve block 15 which is light in weight is located in the third space. As a result, the center of gravity of the housing 10 of the flow dividing controller 2 is located at a lower position. It is therefore possible for a forwarding agent to reduce the probability that for example, a cargo shifting will occur during transport of the flow dividing controller 2, and thus safety transport the flow dividing controller 2.

Embodiment 2

According to Embodiment 2, in the flow dividing controller 2 in the air-conditioning apparatus 100, the layout of the first pump 13*a*, the second pump 13*b*, the first plate heat exchanger 14*a*, and the second plate heat exchanger 14*b* in the flow dividing controller 2 according to Embodiment 1 is determined in relation to a control box 16.

Figure 3:
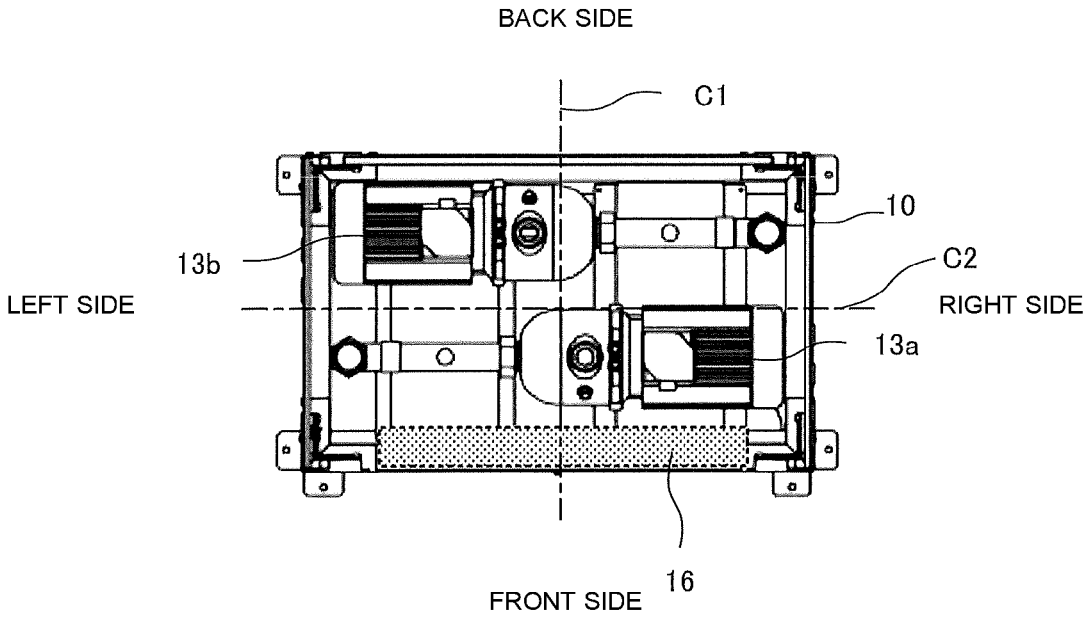
FIG. 3 is a top view illustrating a positional relationship between a first pump and a second pump and a control box as the flow dividing controller in the air-conditioning apparatus according to Embodiment 2 is viewed from the X-X direction as indicated in FIG. 2.

FIG. 3 is a top view illustrating a positional relationship between the first pump 13*a* and the second pump 13*b* and the control box 16 as the flow dividing controller 2 in the air-conditioning apparatus 100 according to Embodiment 2 is viewed in the X-X direction as indicated in FIG. 2.

Referring to FIG. 3, a first horizontal line C1 passes through, the central portion of the housing 10 in the lateral direction, in a direction from the front side to the back side. In FIG. 3, a second horizontal line C2 passes through, a central portion of the housing 10 in a front-back direction, that is, in the direction from the front side to the back side, in a direction from the left side to the right side; that is, in the lateral direction.

As illustrated in FIG. 3, the control box 16 is provided on a front side of the inside of the housing 10. The control box 16 houses a controller that controls components in the flow dividing controller 2, such as valves of the valve block 15, valves for use in the flow switching device 5, the first pump 13*a*, and the second pump 13*b*.

The first pump 13*a* and the second pump 13*b* are located laterally symmetrically with reference to the center line C (see FIG. 2) extending in the vertical direction such that the first pump 13*a* and the second pump 13*b* are located opposite to each other (see FIG. 2). As viewed above, the first pump 13*a* and the second pump 13*b* are located; in the vicinity of the central portion of the housing 10 in the front-back direction and the lateral direction, such that the first pump 13*a* and the second pump 13*b* are not in contact with the control box 16.

Figure 4:
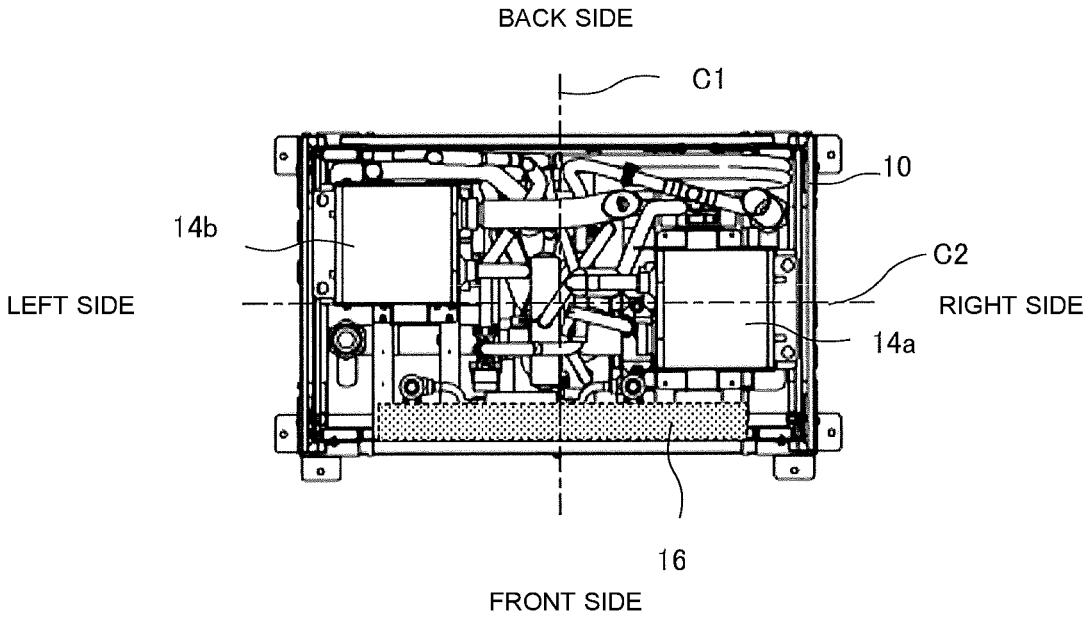
FIG. 4 illustrates a positional relationship between a first plate heat exchanger and a second plate heat exchanger and the control box as the flow dividing controller in the air-conditioning apparatus according to Embodiment 2 is viewed from the Y-Y direction as indicated in FIG. 2.

FIG. 4 illustrates a positional relationship between the first plate heat exchanger 14*a* and the second plate heat exchanger 14*b* and the control box 16 as the flow dividing controller 2 in the air-conditioning apparatus 100 according to Embodiment 2 is viewed in the Y-Y direction as indicated in FIG. 2.

As illustrated in FIG. 4, the first plate heat exchanger 14*a* is located in the second space above the first pump 13*a* as viewed above. The second plate heat exchanger 14*b* is located in the second space above the second pump 13*b* as viewed above. The first plate heat exchanger 14*a* and the second plate heat exchanger 14*b* are located laterally symmetrically with reference to the center line C extending in the vertical direction, such that the first plate heat exchanger 14*a* and the second plate heat exchanger 14*b* are located opposite to each other without being in contact with the control box 16. The first plate heat exchanger 14*a* and the second plate heat exchanger 14*b* are located, in the vicinity of the central portion of the housing 10 in the front-back direction and the lateral direction, as viewed above.

In the flow dividing controller 2 of Embodiment 2, the first pump 13*a* and the second pump 13*b* which are heavy in the housing 10 are located, in the first space, in the vicinity of the central portion in the horizontal direction. The first plate heat exchanger 14*a* and the second plate heat exchanger 14*b* are located, in the second space of the housing 10, in the vicinity of the central portion in the horizontal direction. The control box 16 is located in front of the first pump 13*a* and the second pump 13*b* in the first space and in front of the first plate heat exchanger 14*a* and the second plate heat exchanger 14*b* in the second space.

Therefore, the center of gravity of the flow dividing controller 2 according to Embodiment 2 is closer to the central portion of the housing 10 in the front-back direction and in the lateral direction than the flow dividing controller 2 of Embodiment 1. It is therefore possible to more reliably reduce the probability that a cargo shifting will occur during transport of the flow dividing controller 2, using a forklift or other transporters, and thus safely transport the flow dividing controller 2.

The control box 16 is located closer to the front side than the first pump 13*a* and the second pump 13*b* in the first space and close to the front side than the first plate heat exchanger 14*a* and the second plate heat exchanger 14*b* in the second space. Accordingly, the center of gravity of the housing 10 is located in the vicinity of the central portion of the housing 10 in the front-back direction and in the lateral direction. Therefore, even in the case where the housing 10 is stacked on another housing 10, it is therefore possible reduce the probability that the housing 10 stacked on the other housing 10 will be inclined.

Embodiment 3

Services for components includes a service requiring cutting and brazing of pipes and a service not requiring cutting or brazing of pipes. Regarding Embodiment 3, the layout of components for which the service not requiring cutting or brazing of pipes is offered will be described in addition to the components as described above regarding Embodiment 1. The pipes are pipes that connect a component for which a service is offered and other components.

The components for which the service not requiring cutting or brazing of pipes is offered are the following seven components: a coil of a four-way valve 21*a*; solenoid valve coils 22; a check valve coil 23; a three-way valve motor 25; a coil of a four-way valve 21*b*; a tank-body protective valve 24; and the motors 15*b* of the valve block 15 in the flow switching circuit 5*a*.

Figure 5:
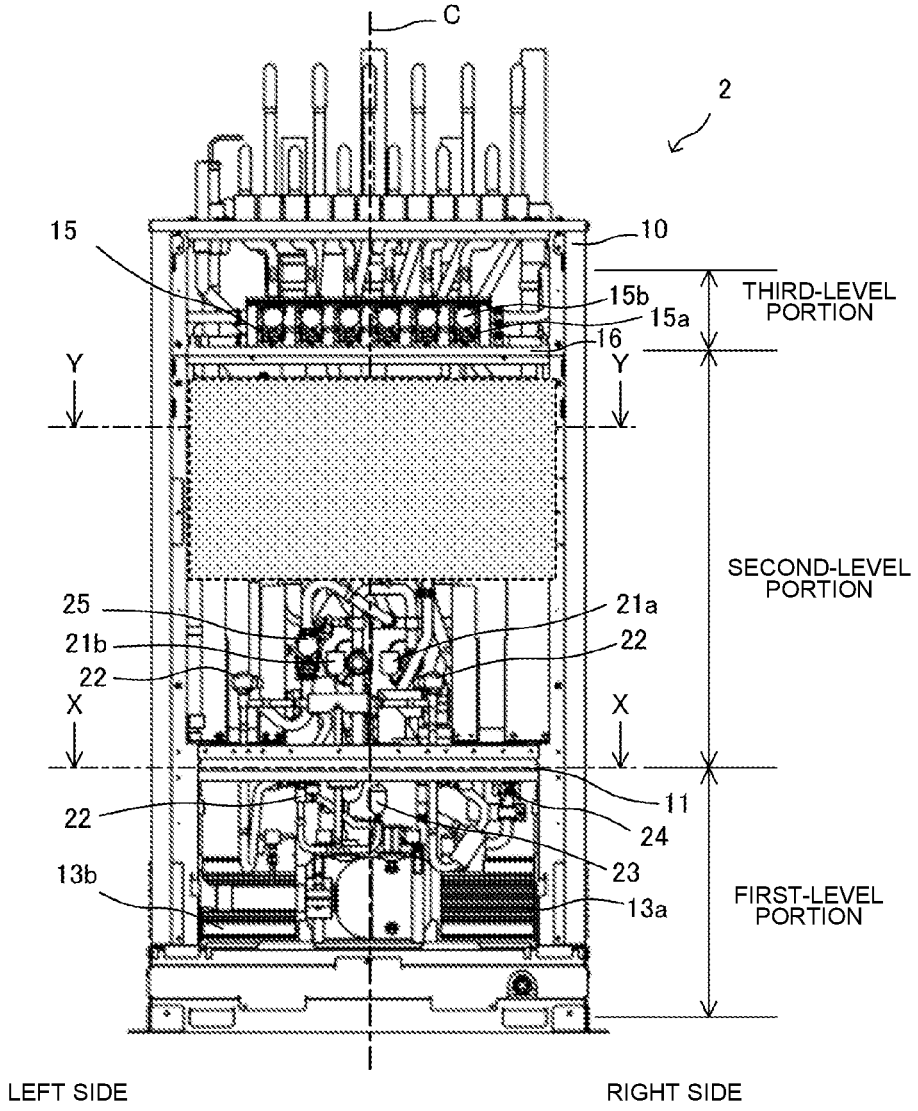
FIG. 5 is a front view of the flow dividing controller in the air-conditioning apparatus according to Embodiment 3.

FIG. 5 is a front view of the flow dividing controller 2 in the air-conditioning apparatus 100 according to Embodiment 3.

The above components excluding the motors 15*b* for the valves 15*a* of the valve block 15, that is, the six components of: the coil of the four-way valve 21*a*; the solenoid valve coils 22; the check valve coil 23; the three-way valve motor 25; the coil of the four-way valve 21*b*; and the tank-body protective valve 24, are located at lower positions than a central portion of the housing 10 in the height direction of the housing 10 as viewed from the front of the housing 10. Of these six components, the coil of the four-way valve 21*a*, the coil of the four-way valve 21*b*, and the three-way valve motor 25 are provided in the second space; the solenoid valve coils 22 are provided in the first space and the second space; and the check valve coil 23 and the tank-body protective valve 24 are provided in the first space.

In Embodiment 3, the control box 16 is provided on the front side of the inside of the housing 10 and in an upper region in the second space.

The above seven components excluding the motors 15*b* of the valve block 15, that is, the six components of the coil of the four-way valve 21*a*, the solenoid valve coils 22, the check valve coil 23, the three-way valve motor 25, the coil of the four-way valve 21*b*, and the tank-body protective valve 24, are located below the control box 16 so as not to be in contact with the control box 16 located on the front side. The motors 15*b* of the valve block 15 are located in the third space above the control box 16 so as not to be in contact with the control box 16 located on the front side.

Figure 6:
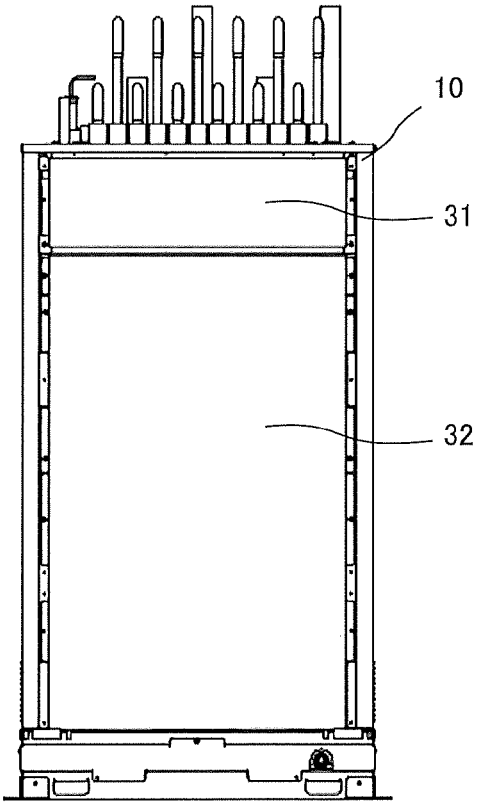
FIG. 6 illustrates a front side of a service panel of the flow dividing controller in the air-conditioning apparatus according to Embodiment 3.

FIG. 6 illustrates the front side of a service panel of the flow dividing controller 2 in the air-conditioning apparatus 100 according to Embodiment 3.

As illustrated in FIG. 6, an upper front panel 31 and a lower front panel 32 are provided on the front side of the housing 10. The upper front panel 31 is located on the front side in the third space of the housing 10. The lower front panel 32 is located on the front side in the first space and the second space of the housing 10.

Coils of the four-way valves 21 (the coil of the four-way valve 21*a* and the coil of the four-way valve 21*b*), the solenoid valve coils 22, the check valve coil 23, and the tank-body protective valve 24, that is, six components, are located on the back side of the lower front panel 32. The motors 15*b* of the valve block 15 are located on the back side of the upper front panel 31.

Therefore, in the flow dividing controller 2 in the air-conditioning apparatus 100 according to Embodiment 3, the components for which a service not requiring cutting or brazing of pipes is offered are located at such positions that the components are not in contact with the control box 16 located on the front side. Thus, it is possible to offer the service without detaching the control box 16.

The front side panel of the flow dividing controller 2 is divided into the upper front panel 31 and the lower front panel 32. Thus, it is possible to reduce the number of service panels, compared with the case where the front side panel is divided into three service panels, that is, first, second, and third spaces.

Embodiment 4

Embodiment 4 relates to the layout of the four-way valve 21*a* and the solenoid valve 22*a* associated with the first plate heat exchanger 14*a* and the first pump 13*a*, which are used mainly in cooling, and the layout of the four-way valve 21*b* and the solenoid valve 22*b* associated with the second plate heat exchanger 14*b* and the second pump 13*b*. The four-way valve 21*a* and the solenoid valve 22*a* are provided at a pipe through which a secondary heat medium cooled at the first plate heat exchanger 14*a* flows. The four-way valve 21*b* and the solenoid valve 22*b* are provided at a pipe through which a secondary heat medium heated at the second plate heat exchanger 14*b* and the second pump 13*b* flows.

Figure 7:
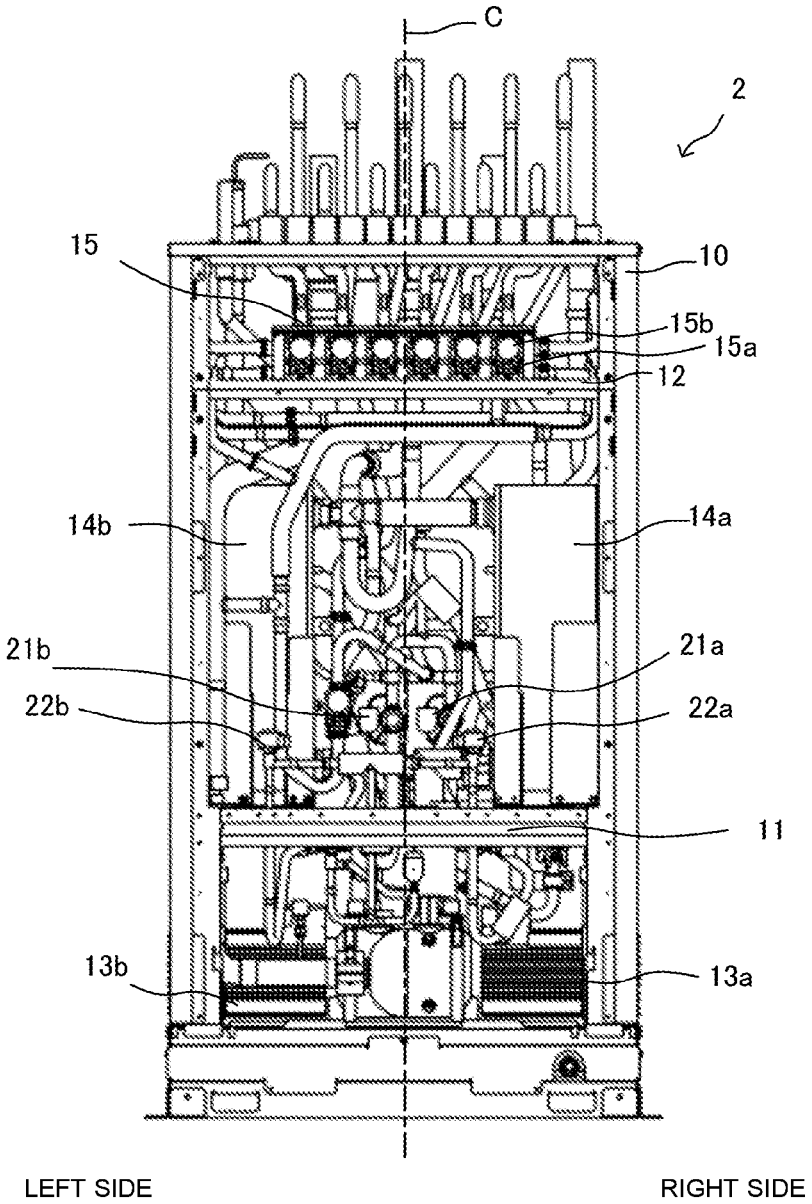
FIG. 7 is a front view of the flow dividing controller in the air-conditioning apparatus according to Embodiment 4.

FIG. 7 is a front view of the flow dividing controller 2 in the air-conditioning apparatus 100 according to Embodiment 4.

As illustrated in FIG. 7, the four-way valve 21*a* and the solenoid valve 22*a* are provided in the second space between the first plate heat exchanger 14*a* and the center line C extending in the vertical direction. The four-way valve 21*b* and the solenoid valve 22*b* are located in the second space between the second plate heat exchanger 14*b* and the center line C.

The four-way valve 21*a* and the solenoid valve 22*a* are located adjacent to each other in the horizontal direction in the vicinity of the first plate heat exchanger 14*a*. The four-way valve 21*a* is located at an upper position than the solenoid valve 22*a*.

The four-way valve 21*a* and the solenoid valve 22*a* are provided at a pipe of the flow switching circuit 5*a* through which a secondary heat medium subjected to heat exchange and cooled at the first plate heat exchanger 14*a* is supplied to the indoor unit 3 (see FIG. 1).

The four-way valve 21*b* and the solenoid valve 22*b* are located adjacent to each other in the lateral direction in the vicinity of the first plate heat exchanger 14*a*. The four-way valve 21*b* is located at a higher position than the solenoid valve 22*b*.

The four-way valve 21*b* and the solenoid valve 22*b* are provided at a pipe of the flow switching circuit 5*a* through which a secondary heat medium subjected to heat exchange and heated at the second plate heat exchanger 14*b* is supplied to the indoor unit 3.

The four-way valve 21*a* and the solenoid valve 22*a* are located adjacent to the four-way valve 21*b* and the solenoid valve 22*b*. The four-way valve 21*b* and the solenoid valve 22*b* are located between the second plate heat exchanger 14*b* and the four-way valve 21*a* and the solenoid valve 22*a*.

Therefore, in the flow dividing controller 2 of Embodiment 4, the four-way valve 21*a* and the solenoid valve 22*a* are located in the second space and in the vicinity of the first plate heat exchanger 14*a*. Thus, it is possible to reduce the length of a cooling-side pipe that connects the four-way valve 21*a* and the solenoid valve 22*a*. The four-way valve 21*b* and the solenoid valve 22*b* are located in the second space and in the vicinity of the second plate heat exchanger 14*b*. Thus, it is possible to reduce the length of a heating-side pipe that connects the four-way valve 21*b* and the solenoid valve 22*b*. As a result, pipe processing costs and material costs can be reduced. Furthermore, in the flow dividing controller 2 of Embodiment 4, it is possible to reduce the length of the pipes and thus reduce occurrence of a stress at the pipes.

In the flow dividing controller 2 of Embodiment 4, since the components for the cooling are separated from those for the heating, it is possible to easily check and grasp the flow of a heat medium. The components for the cooling include the first pump 13*a*, the first plate heat exchanger 14*a*, the four-way valve 21*a*, and the solenoid valve 22*a*. The components for the heating include the second pump 13*b*, the second plate heat exchanger 14*b*, the four-way valve 21*b*, and the solenoid valve 22*b*.

Embodiment 5

In the flow dividing controller 2 of Embodiment 5, a base metal sheet 41*b* for the plate heat exchanger 14 and a base metal sheet 41*c* for the valve block 15 are provided.

Figure 8:
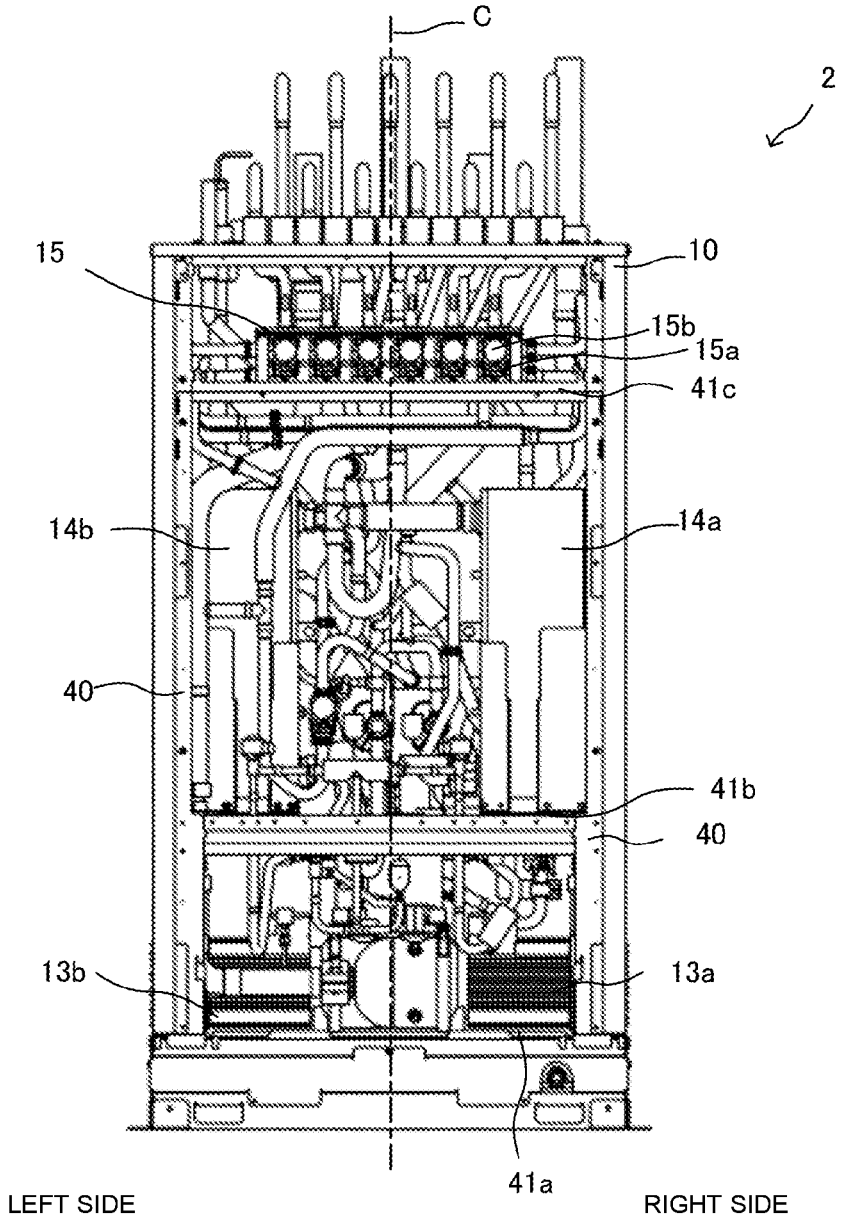
FIG. 8 is a front view of the flow dividing controller in the air-conditioning apparatus according to Embodiment 5.

FIG. 8 is a front view of the flow dividing controller 2 in the air-conditioning apparatus 100 according to Embodiment 5.

Four columns 40 are provided at four corners of the housing 10 having a cuboid shape. The four columns 40 extend in the vertical direction. It should be noted that FIG. 8 illustrates only two of the columns 40 that are located on the front side. The base metal sheet 41*b* for the first plate heat exchanger 14*a* and the second plate heat exchanger 14*b* is fixed to the four columns 40. At a higher position than the base metal sheet 41*b*, the base metal sheet 41*c* for the valve block 15 is fixed to the four columns 40.

The first plate heat exchanger 14*a* and the second plate heat exchanger 14*b* are fixed to the base metal sheet 41*b*. The valve block 15 is fixed to the base metal sheet 41*c*.

The first pump 13*a* and the second pump 13*b* are fixed to a base metal sheet 41*a* located at a bottom portion of the housing 10.

At an initial stage of assembling the flow dividing controller 2 as described above, the four columns 40 are provided at the respective corners of the bottom portion of the housing 10. Then, the base metal sheet 41*b* to which the first plate heat exchanger 14*a* and the second plate heat exchanger 14*b* are fixed and the base metal sheet 41*c* to which the valve block 15 is fixed are attached to the columns 40.

In the flow dividing controller 2 according to Embodiment 5, the first plate heat exchanger 14*a* and the second plate heat exchanger 14*b* are fixed to the base metal sheet 41*b*, and the valve block 15 is fixed to the base metal sheet 41*c*. Therefore, the weights of these components are not loaded on the first pump 13*a* or the second pump 13*b*. It is therefore possible to reduce the probability that a failure will occur in the first pump 13*a* or the second pump 13*b*.

The first pump 13*a* and the second pump 13*b* are fixed to the base metal sheet 41*a*. The first plate heat exchanger 14*a* and the second plate heat exchanger 14*b* are fixed to the base metal sheet 41*b*. The valve block 15 is fixed to the base metal sheet 41*c*. Therefore, these components are easily positioned at the time of assembling the flow dividing controller 2. Furthermore, since these main components are fixed to the base metal sheet 41*a*, the base metal sheet 41*b*, and the base metal sheet 41*c*, and are thus positioned, the pipes and other components can be easily assembled.

Unlike existing horizontal flow dividing controllers, the flow dividing controller 2 of Embodiment 5 is vertically oriented, in which the first plate heat exchanger 14*a*, the second plate heat exchanger 14*b*, and the valve block 15 are arranged in the vertical direction. In this configuration, the first plate heat exchanger 14*a*, the second plate heat exchanger 14*b*, and the valve block 15 are moved downward due to their own weights in the direction of gravity.

In the flow dividing controller 2 of Embodiment 5, the first plate heat exchanger 14*a* and the second plate heat exchanger 14*b* are fixed to the columns 40, with the base metal sheet 41*b* interposed therebetween, and the valve block 15 is fixed to the columns 40, with the base metal sheet 41*c* interposed therebetween. Because of this configuration, it is possible to reduce the probability that these components will be moved downward. As a result, it is possible to easily assembly the flow dividing controller 2.

Figure 9:
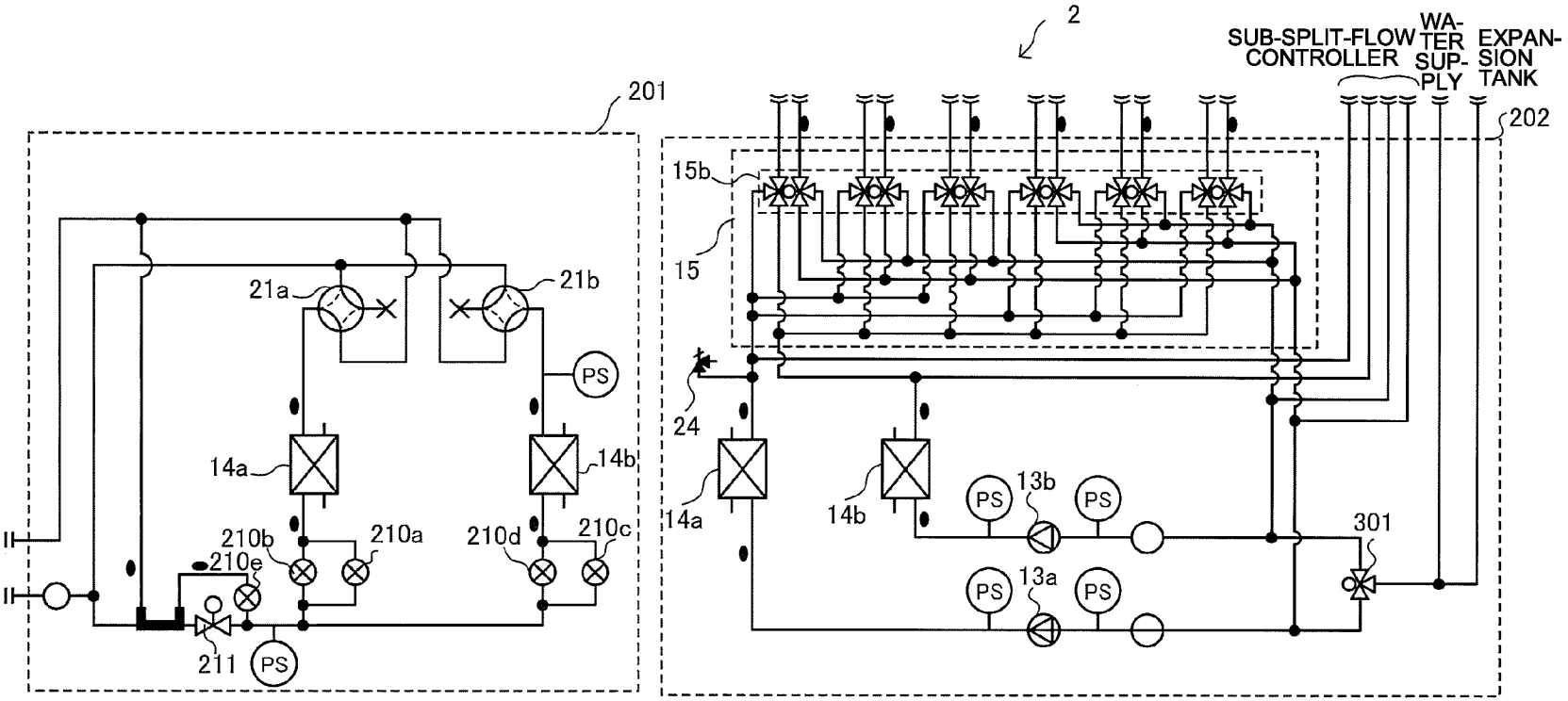
FIG. 9 illustrates an example of the circuit diagram of the flow dividing controller in the air-conditioning apparatus according to each of Embodiments 1, 2, 3, 4, and 5.

FIG. 9 illustrates an example of the circuit diagram of the flow dividing controller 2 in the air-conditioning apparatus 100 according to each of Embodiments 1, 2, 3, 4, and 5.

As illustrated in FIG. 9, the flow dividing controller 2 includes a refrigerant circuit 201 and a water circuit 202.

In the refrigerant circuit 201, refrigerant from the outdoor unit 1 circulates. The refrigerant circuit 201 includes the four-way valve 21*a*, the four-way valve 21*b*, the first plate heat exchanger 14*a*, the second plate heat exchanger 14*b*, solenoid valves 210*a*, 210*b*, 210*c*, 210*d*, and 210*e*, and a check valve 211.

The four-way valves 21*a* and 21*b* are connected to refrigerant pipes extending from the outdoor unit 1, and each change a flow passage in the refrigerant circuit 201 depending on whether the cooling operation or the heating operation is performed. The four-way valve 21*a* and the four-way valve 21*b* are connected to the first plate heat exchanger 14*a* and the second plate heat exchanger 14*b*, respectively, by respective pipes.

The solenoid valves 210*a* and 210*b* are connected parallel to a pipe located on the downstream side of the first plate heat exchanger 14*a*. The solenoid valves 210*a* and 210*b* adjust the flow rate of refrigerant that flows in the first plate heat exchanger 14*a*. The solenoid valves 210*c* and 210*d* are connected parallel to a pipe located on the downstream side of the second plate heat exchanger 14*b*. The solenoid valves 210*c* and 210*d* adjust the flow rate of refrigerant that flows in the second plate heat exchanger 14*b*.

The solenoid valve 210*e* and the check valve 211 are connected parallel to pipes located on the downstream side of the solenoid valves 210*a*, 210*b*, 210*c*, and 210*d*. The solenoid valve 210*e* adjusts the flow rate of refrigerant that flows in the first plate heat exchanger 14*a* and the second plate heat exchanger 14*b*. The check valve 211 is configured to prevent backflow of refrigerant that flows through a pipe. Refrigerant that passes through the pipe at which the solenoid valve 210*e* is provided returns to the outdoor unit 1.

The solenoid valves 210*a*, 210*b*, 210*c*, 210*d*, and 210*e* include respective solenoid valve coils 22 (see FIG. 5).

The water circuit 202 includes the first pump 13*a*, the second pump 13*b*, the first plate heat exchanger 14*a*, the second plate heat exchanger 14*b*, a three-way valve 301, and the valve block 15. The valves 15*a* of the valve block 15 (see FIG. 2) include the respective motors 15*b*.

The three-way valve 301 is connected to a water supply and expansion tank by a water supply pipe. The three-way valve 301 is connected to the first pump 13*a* and the second pump 13*b* by pipes. The first pump 13*a* and the second pump 13*b* are connected parallel to each other. The three-way valve 301 has a function of causing air to be removed from the water circuit 202 and equalizing the pressure in the water circuit 202.

One of the ports of the three-way valve 301 is connected to the water supply and expansion tank. One of the other two ports is connected to the first pump 13*a* by a pipe. The first pump 13*a* compresses water supplied from the three-way valve 301 and transfers the compressed water. The first pump 13*a* and the first plate heat exchanger 14*a* are connected by a pipe. The valves 15*a* of the valve block 15 include a valve 15*a* for cooling (see FIG. 7) and a valve 15*a* for heating (see FIG. 7) that are both provided for a single indoor unit 3. The first plate heat exchanger 14*a* is connected to the tank-body protective valve 24 and the valves 15*a* for cooling in the valve block 15 by pipes. The valves 15*a* include the respective motors 15*b*. Water that passes through one of the valves 15*a*, which is a valve 15*a* for cooling that is in an opened state, is supplied to the indoor unit 3 associated with to this valve 15*a* for cooling and being in the opened state.

One of the ports of the three-way valve 301 is connected to the water supply and expansion tank. The other of the other two ports is connected to the second pump 13*b* by a pipe. The second pump 13*b* compresses water supplied from the three-way valve 301 and transfers the compressed water. The second pump 13*b* and the second plate heat exchanger 14*b* are connected by a pipe. The second plate heat exchanger 14*b* is connected to valves 15*a* for heating in the valve block 15 by pipes. The valves 15*a* include the respective motors 15*b*. Water that passes through one of the valves 15*a*, which is a valve 15*a* for heating that is in an opened state, is supplied to the indoor unit 3 associated with this valve 15*a* for heating and being in the opened state.

It should be noted that the valve block 15 and sub-flow dividing controllers are connected parallel to the first plate heat exchanger 14*a* and the second plate heat exchanger 14*b*.

The first plate heat exchanger 14*a* and the second plate heat exchanger 14*b* according to each of Embodiments 1, 2, 3, 4, and 5 will also be referred to as "first heat exchanger" and "second heat exchanger," respectively. The four-way valve 21*a* and the solenoid valve 22*a* will also be referred to as "first valve." The four-way valve 21*b* and the solenoid valve 22*b* will also be referred to as "second valve."

The embodiments are each merely described as an example, and the descriptions regarding the embodiments are not intended to limit the scope of the claims. The embodiments can be variously modified and put to practical use. Various omissions, replacements, and changes can be made without departing from the scope of the embodiments. These embodiments and modifications thereof fall within the scope and gist of the embodiments.

REFERENCE SIGNS LIST

1: outdoor unit, 2: flow dividing controller, 3: indoor unit, 4: heat exchanger, 5: flow switching device, 5*a*: flow switching circuit, 6: pump, 10: housing, 11: first partition, 12: second partition, 13*a*: first pump, 13*b*: second pump, 14: plate heat exchanger, 14*a*: first plate heat exchanger, 14*b*: second plate heat exchanger, 15: valve block, 15*a*: valve, 15*b*: motor, 16: control box, 21, 21*a*, 21*b*: four-way valve, 22, 22*a*, 22*b*: solenoid valve coil, 23: check valve coil, 24: tank-body protective valve, 25: three-way valve motor, 31: upper front panel, 32: lower front panel, 40: column, 41*a*, 41*b*, 41*c*: base metal sheet, 100: air-conditioning apparatus, C: center line, C1: first horizontal line, C2: second horizontal line, 201: refrigerant circuit, 202: water circuit, 210*a*, 210*b*, 210*c*, 210*d*, 210*e*: solenoid valve, 211: check valve

The invention claimed is:

1. A heat medium relay device comprising:

a housing having a vertical cuboid shape, and having an interior partitioned into a first space, a second space above the first space, and a third space above the second space;

a first heat exchanger provided in the second space, and configured to cause heat exchange to be performed between a primary heat medium and a secondary heat medium, the primary heat medium being in a cooled state and supplied from an outdoor unit;

a first pump provided in the first space, and configured to pressurize the secondary heat medium subjected to the heat exchange at the first heat exchanger, and circulate the pressurized secondary heat medium between the first pump and at least one indoor unit;

a second heat exchanger provided in the second space, and configured to cause heat exchange to be performed between the primary heat medium and the second heat medium, the primary heat medium being in a heated state and supplied from the outdoor unit;

a second pump provided in the first space, and configured to pressurize the secondary heat medium subjected to the heat exchange at the second heat exchanger, and circulate the pressurized secondary heat medium between the second pump and the at least one indoor unit; and a valve block provided in the third space, the valve block including a plurality of valves to allow the secondary heat medium subjected to the heat exchange at the first heat exchanger and the secondary heat medium subjected to the heat exchange at the second heat exchanger to flow to the at least one indoor unit, the valve block being lighter in weight than each of the first heat exchanger, the first pump, the second heat exchanger, and the second pump.

2. The heat medium relay device of claim 1, comprising a control box that houses a controller configured to control the valves of the valve block, wherein the first pump and the second pump are provided laterally symmetrically with reference to a center line which passes through a central portion of the housing that is a center thereof in a horizontal direction, and which extends in a vertical direction, the first heat exchanger and the second heat exchanger are provided laterally symmetrically in the horizontal direction with reference to the center line, and the control box is provided closer to a front side in the first space than the first pump and the second pump, and closer to a front side in the second space than the first heat exchanger and the second heat exchanger.

3. The heat medium relay device of claim 1, wherein the housing includes a lower front panel provided on the front side in the first space and the second space, an upper front panel provided on a front side in the third space and above the lower front panel, components for which a service not requiring cutting or brazing of pipes is offered, and a control box provided over an upper region of the second space and a lower region of the third space that are located a front side of the housing, and the components are provided in the first space and the second space, and located below the control box and on a back side of the lower front panel.

4. The heat medium relay device of claim 1, comprising:

a first valve provided adjacent to the first heat exchanger in a horizontal direction and between a center line and the first heat exchanger, the center line extending in a vertical direction and passing through a central portion of the housing that is a center thereof in the horizontal direction, the first valve being provided at a pipe through which the secondary heat medium passes, the secondary heat medium being subjected to the heat exchange and cooled at the first heat exchanger; and a second valve provided adjacent to the second heat exchanger in the horizontal direction and between the second heat exchanger and the first valve, the second valve being provided at a pipe through which the secondary heat medium passes, the secondary heat medium being subjected to the heat exchange and heated at the second heat exchanger.

5. The heat medium relay device of claim 1, wherein the housing includes columns extending in a vertical direction from respective corners of the housing, a first metal sheet to which the first heat exchanger and the second heat exchanger is fixed, the first metal sheet being fixed to the columns in a horizontal direction, and a second metal sheet to which the valve block is fixed, the second metal sheet being fixed to the columns in the horizontal direction at a higher position than the first metal sheet.

* * * * *